US010630003B2

(12) United States Patent
Nakai

(10) Patent No.: US 10,630,003 B2
(45) Date of Patent: Apr. 21, 2020

(54) CONDUCTOR CONNECTING STRUCTURE AND WIRE HARNESS

(71) Applicant: SUMITOMO WIRING SYSTEMS, LTD., Yokkaichi-shi, Mie (JP)

(72) Inventor: Hirokazu Nakai, Yokkaichi (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 16/091,281

(22) PCT Filed: Apr. 3, 2017

(86) PCT No.: PCT/JP2017/013903

§ 371 (c)(1),
(2) Date: Oct. 4, 2018

(87) PCT Pub. No.: WO2017/175699

PCT Pub. Date: Oct. 12, 2017

(65) Prior Publication Data

US 2019/0157775 A1 May 23, 2019

(30) Foreign Application Priority Data

Apr. 7, 2016 (JP) ..... 2016-077090

(51) Int. Cl.

| | |
|---|---|
| ***H01R 4/20*** | (2006.01) |
| ***H01R 4/62*** | (2006.01) |
| ***H01R 4/18*** | (2006.01) |

(52) U.S. Cl.

CPC ..... *H01R 4/20* (2013.01); *H01R 4/183* (2013.01); *H01R 4/62* (2013.01)

(58) Field of Classification Search

CPC ..... H01R 4/20; H01R 4/183

(Continued)

(56) References Cited

U.S. PATENT DOCUMENTS 2,535,013 A * 12/1950 Freedom ..... H01R 43/058 439/877
5,499,448 A * 3/1996 Tournier ..... H01R 4/183 29/862

(Continued)

FOREIGN PATENT DOCUMENTS

JP S48-000485 U 1/1973
JP S48-078981 U 9/1973

(Continued)

OTHER PUBLICATIONS

Apr. 25, 2017 International Search Report issued in International Patent Application No. PCT/JP2017/013903.

*Primary Examiner* — Sherman Ng
(74) *Attorney, Agent, or Firm* — Oliff PLC

(57) ABSTRACT

A conductor connecting structure and a wire harness are able to improve connection reliability. An end portion of a first conductor and an end portion of a second conductor overlap each other in a radial direction, and a tubular member encloses, and is crimped onto, an overlapping portion where the first conductor and the second conductor overlap each other. With this configuration, it is possible to make a joint strong enough to resist a force applied in a direction in which the end portion of the first conductor and the end portion of the second conductor are detached from each other, and therefore it is possible to improve the reliability of connection between the first conductor and the second conductor.

2 Claims, 5 Drawing Sheets

(58) Field of Classification Search
USPC ..... 174/84 C
See application file for complete search history.

(56) References Cited

U.S. PATENT DOCUMENTS

| | | | | |
|---|---|---|---|---|
| 2005/0227550 | A1* | 10/2005 | Takayama | H01R 4/185 439/851 |
| 2009/0117787 | A1* | 5/2009 | Kerner | H01R 4/20 439/877 |
| 2011/0083324 | A1* | 4/2011 | Martauz | H01R 4/185 29/863 |
| 2013/0130569 | A1* | 5/2013 | Sato | H01R 4/206 439/882 |
| 2014/0224536 | A1* | 8/2014 | Ito | H01R 4/184 174/84 C |
| 2014/0246231 | A1* | 9/2014 | Adachi | B60R 16/0207 174/72 A |
| 2014/0374155 | A1* | 12/2014 | Tachibana | H01R 4/62 174/84 C |
| 2015/0064991 | A1 | 3/2015 | Kawamura et al. | |
| 2015/0140856 | A1* | 5/2015 | Sato | H01R 4/70 439/523 |
| 2015/0364837 | A1* | 12/2015 | Yagi | B23K 26/24 439/879 |
| 2016/0148720 | A1* | 5/2016 | Kanagawa | H01R 4/726 174/115 |

FOREIGN PATENT DOCUMENTS

| | | | |
|---|---|---|---|
| JP | S52-129952 | U | 10/1977 |
| JP | H07-161448 | A | 6/1995 |
| JP | 2005-197159 | A | 7/2005 |
| JP | 2009-231108 | A | 10/2009 |
| WO | 2015/002180 | A1 | 1/2015 |

* cited by examiner

CONDUCTOR CONNECTING STRUCTURE AND WIRE HARNESS

TECHNICAL FIELD

The present disclosure relates to a conductor connecting structure and a wire harness.

BACKGROUND ART

Conventionally, different types of conductors are connected to each other in a wire harness that is to be mounted on, for example, a vehicle or the like. For example, Patent Document 1 below discloses that, in order to reduce the diameter of electrical wires in a wire harness, single-core wires, which have a small diameter, are used in a section that does not need to be flexible, twisted wires are used in a section that needs to be flexible, and single-core wires and twisted wires are connected to each other. A flat squashed portion is provided at an end of a single-core wire, and the squashed portion and the conductor of a twisted wire are connected to each other through ultrasonic welding.

CITATION LIST

Patent Document

Patent Document 1: WO 2015/002180A1

SUMMARY

Technical Problem

However, with the above-described configuration, it is difficult to make a joint strong enough to resist a force applied in a direction in which the squashed portion of the single-core wire and the conductor of the twisted wire are detached from each other. Therefore, there has been demand for a conductor connecting structure that can improve connection reliability when different types of conductors are connected to each other.

The present disclosure has been completed in view of the above-described situation, and aims to provide a conductor connecting structure and a wire harness that can improve connection reliability.

Solution to Problem

A conductor connecting structure according to one embodiment is a conductor connecting structure including a first conductor and a second conductor that are elongated and are connected to each other in a lengthwise direction, wherein one conductor out of the first conductor and the second conductor is a pipe member, and includes a barrel portion that has a barreled shape that encloses an end portion of the other conductor, an end portion of the first conductor and an end portion of the second conductor overlap each other in a direction that intersects the lengthwise direction, and a tubular member encloses, and is crimped onto, an overlapping portion where the first conductor and the second conductor overlap each other.

A wire harness according to one embodiment includes the above-described conductor connecting structure.

Advantageous

According to one embodiment, it is possible to make a joint strong enough to resist a force applied in a direction in which the end portion of the first conductor and the end portion of the second conductor are detached from each other, and therefore it is possible to improve the reliability of connection between the first conductor and the second conductor. Also, according to a preferred embodiment, one conductor out of the first conductor and the second conductor has a barreled shape that encloses an end portion of the other conductor. Such a configuration increases the contact area between the first conductor and the second conductor, and can further improve connection reliability.

EMBODIMENTS

Figure 1:
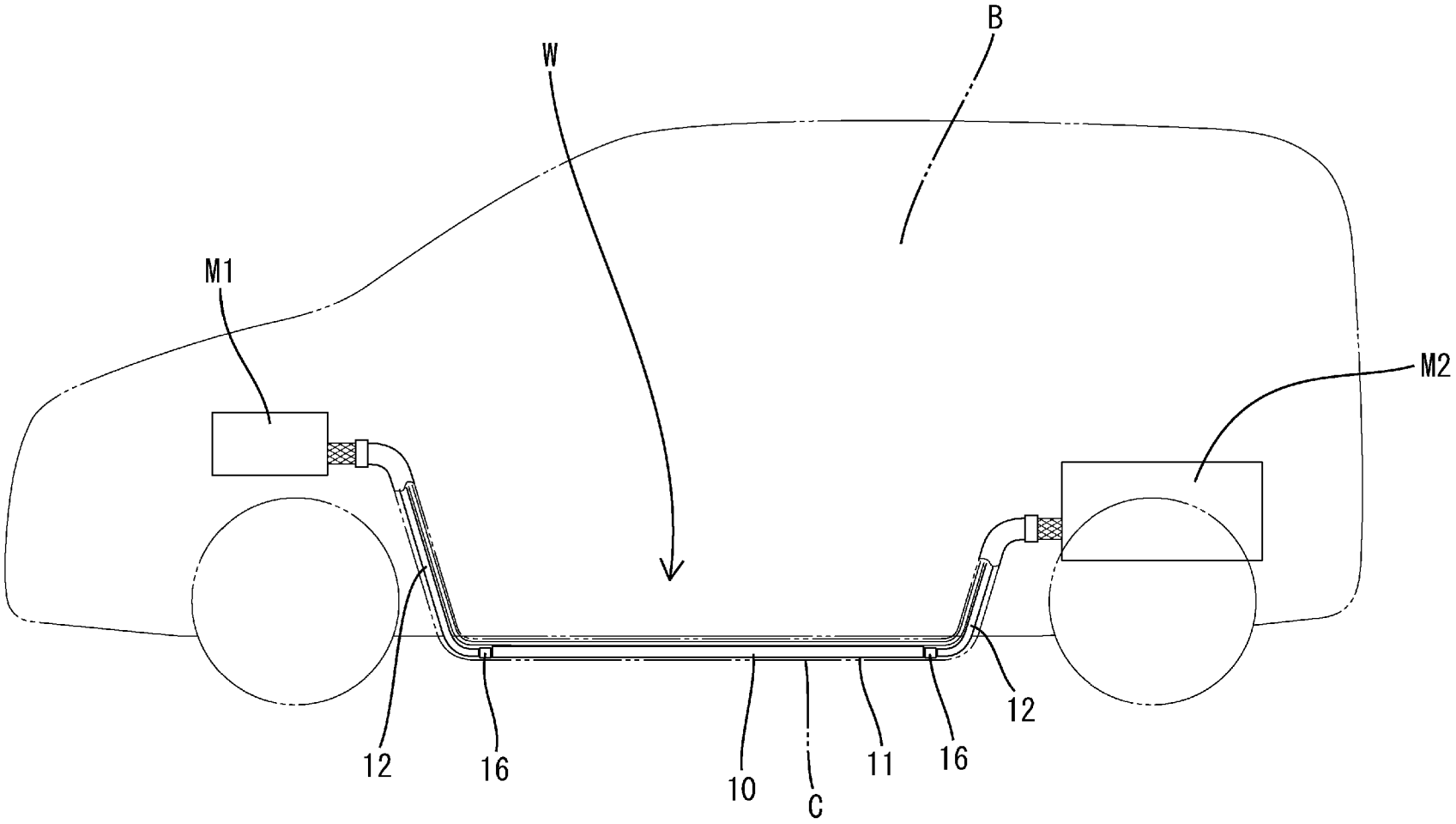
FIG. 1 is a schematic diagram showing a wire harness according to an embodiment, and showing a state in which the wire harness is attached to a vehicle.
Figure 2:
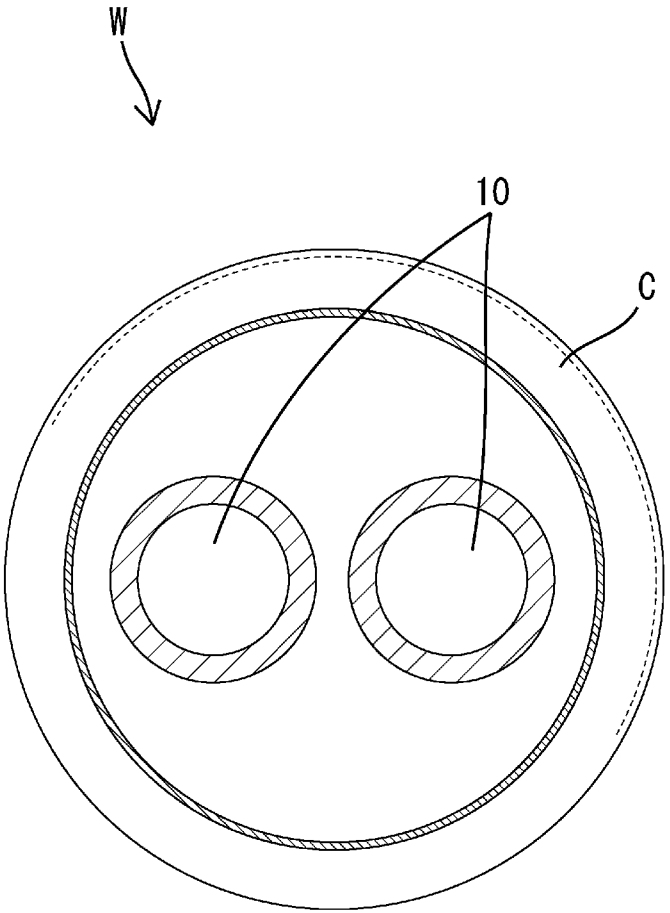
FIG. 2 is a cross-sectional view showing the wire harness.
Figure 3B:
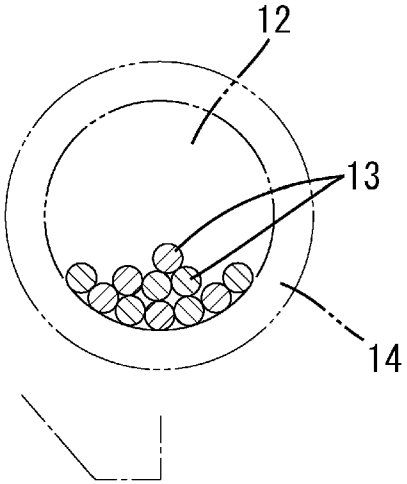
FIG. 3 is a diagram illustrating the task of connecting a first conductor and a second conductor to each other, where (A) is a front view of an end portion of a pipe before a barrel portion has been formed, (B) is a cross-sectional view showing how the second conductor is set in the barrel portion, (C) is a cross-sectional view showing a state in which a tubular member is set in an overlapping portion, and (D) is a cross-sectional view showing a state in which the tubular member is crimped.
Figure 3B:
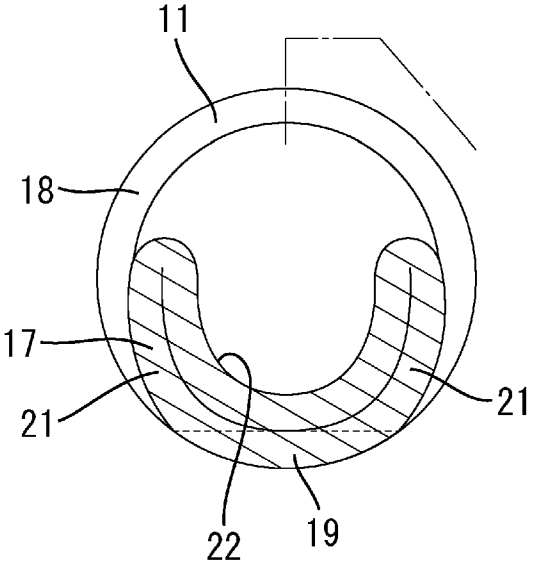
Figure 3A:
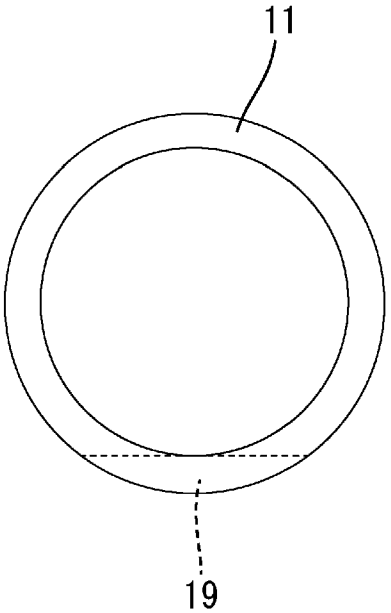
Figure 3D:
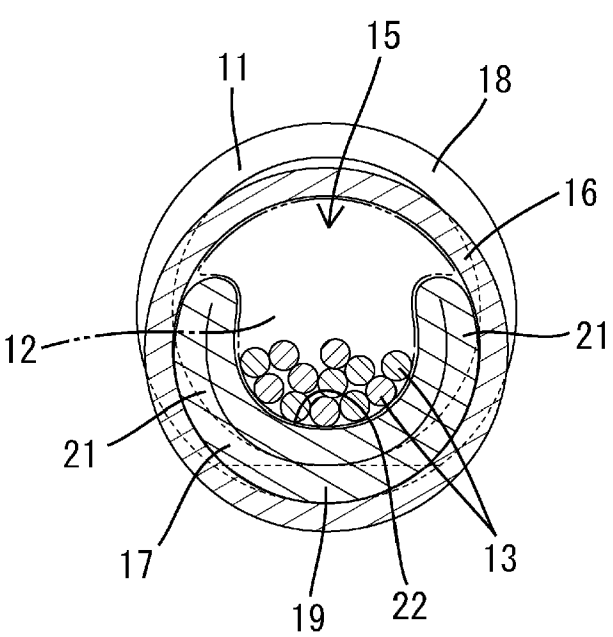
Figure 3C:
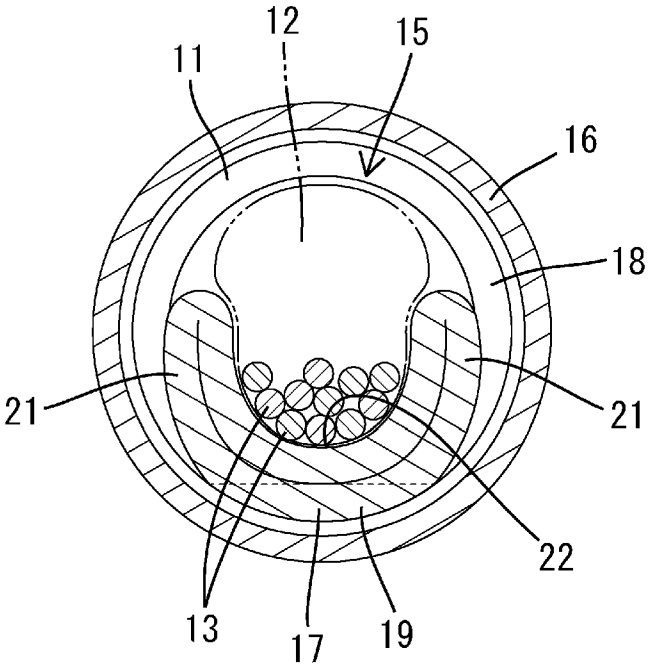

The following shows preferable embodiments.

In the conductor connecting structure according to a preferred embodiment, the tubular member may be shrunken so as to have a circular shape. With such a configuration, it is unlikely that an edge is formed on a joint between the first conductor and the second conductor. Therefore, it is possible to prevent the joint between the first conductor and the second conductor from catching on another component such as an outer sheath member.

Embodiment

The following describes a specific embodiment in detail with reference to FIGS. 1 to 4.

A wire harness W according to the present embodiment is an unshielded low-voltage harness. The wire harness W includes conductive wires 10 that connect a device M1 that is mounted in a front portion of a vehicle body B, such as an auxiliary battery (12 V battery), and a device M2 that is mounted in a rear portion of the vehicle body B, such as a PDU (Power Drive Unit) or an IPU (Intelligent Power Unit), to each other, and is routed under the floor of the vehicle body B so as to extend in a front-rear direction. A large portion of each conductive wire 10 extends in a substantially horizontal direction along and under the floor of the vehicle, and front and rear end portions are bent upward toward the cabin of the vehicle. The conductive wires 10 are inserted into an outer sheath member C that has an elongated tubular shape, and are thus insulated and protected. The outer sheath member C is provided along almost the entire length of the conductive wires 10. The outer sheath member C may be any outer sheath member such as a corrugated tube or a resin pipe.

Each conductive wire 10 is formed by electrically connecting different types of conductors, namely a first conductor 11 and second conductors 12, to each other in a lengthwise direction. Two end portions of each conductive wire 10 preferably have excellent flexibility to facilitate that the task of connecting the devices M1 and M2 to each other, and a large portion of each conductive wire 10 excluding the two end portions is preferably kept in a predetermined shape so as not to sag, for example. Therefore, in the present embodiment, the second conductors 12, which are relatively flexible, are used at the two end portions of each conductive wire 10, and the first conductor 11, which is relatively rigid, is used at the portion other than the two end portions.

The first conductor 11 is configured to keep its shape upon being bent so as to have a predetermined shape, and is bent in a three-dimensional direction along a predetermined routing path. The second conductors 12 have excellent flexibility and can be easily bent so as to have a predetermined shape.

The first conductor 11 is an elongated pipe member that has a circular cross section. The pipe member is made of aluminum or an aluminum alloy, for example. Each second conductor 12 is a twisted wire conductor formed by twisting a plurality of metal strands 13 together. Each twisted wire conductor is made of copper, a copper alloy, aluminum, or an aluminum alloy, for example. Almost the entire length of each twisted wire conductor is enclosed in an insulation coating 14, and a predetermined length of the insulation coating 14 has been stripped off from two end portions of each twisted wire conductor so that the two end portions are exposed to the outside. Metal terminal parts (not shown) are connected to end portions of each twisted wire conductor (two end portions in the lengthwise direction of each conductive wire 10). The metal terminal parts are to be connected to the devices M1 and M2.

Figure 4A:
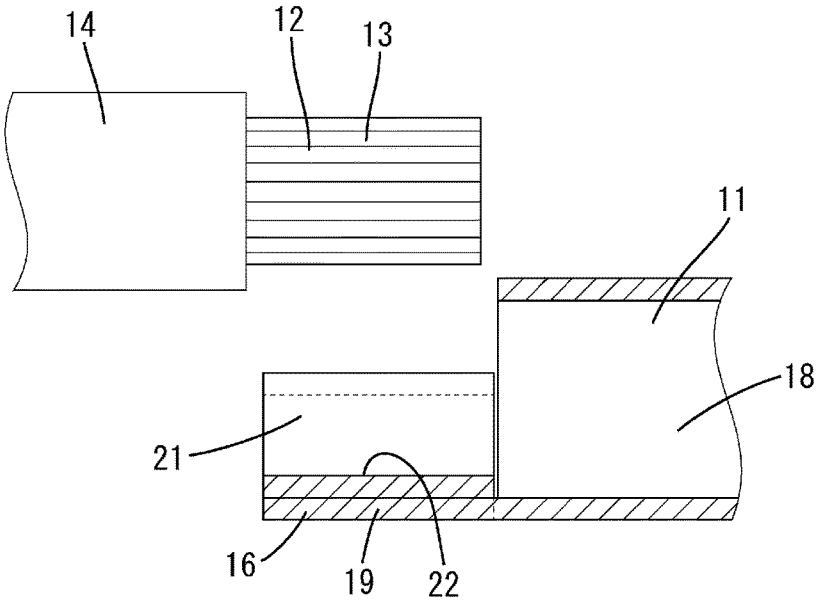
FIG. 4 is a cross-sectional view illustrating the task of connecting the first conductor and the second conductor to each other, where (A) is a cross-sectional view showing how the second conductor is set in the barrel portion, (B) is a cross-sectional view showing a state in which the tubular member is set in the overlapping portion, and (C) is a cross-sectional view showing a state in which the tubular member is crimped.
Figure 4B:
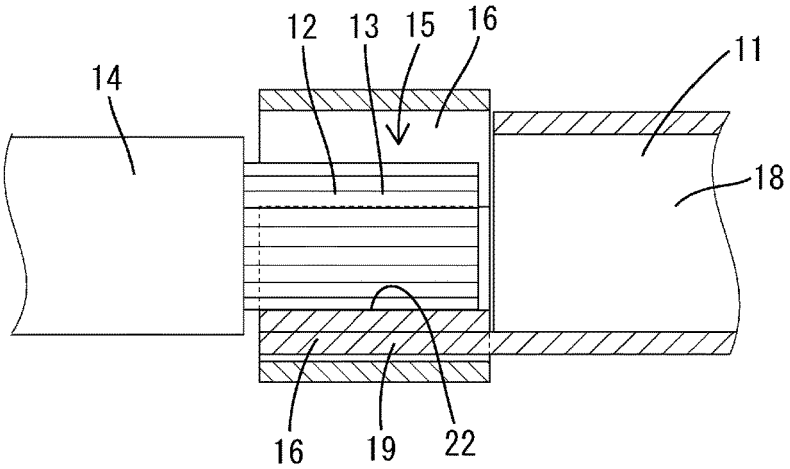
Figure 4C:
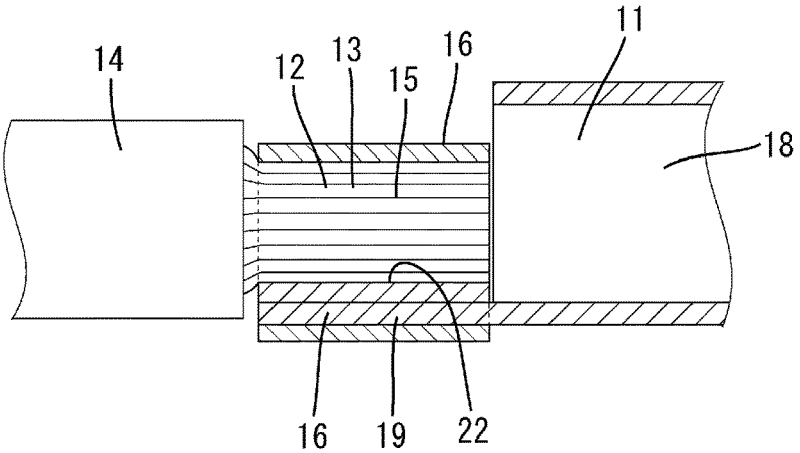

The two end portions of the first conductor 11 and an end portion of each second conductor 12 are electrically connected to each other. As shown in FIG. 4, an end portion of the first conductor 11 and an end portion of a second conductor 12 overlap each other in a radial direction, and a tubular member 16 is crimped onto a portion where the first conductor 11 and the second conductor 12 overlap each other (hereinafter referred to as "the overlapping portion 15").

As shown in FIG. 3, each end portion of the first conductor 11 has a barreled shape that encloses an end portion of a second conductor 12. Hereinafter, each barreled portion of the first conductor 11 is referred to as a "barrel portion 17".

Each barrel portion 17 and another portion (hereinafter referred to as a conductor body portion 18") of a first conductor 11 are mostly separated from each other in the axial direction, but each barrel portion 17 and the conductor body portion 18 are connected to each other along a section extending in a circumferential direction. Hereinafter, a portion of each barrel portion 17 connected to the conductor body portion 18 is referred to as a base portion 19.

An end portion of the first conductor 11 separated from the conductor body portion 18 is squashed toward the base portion 19 so that there is no space inside the inner circumferential surface thereof, and thus each barrel portion 17 has the shape of a single plate. Each barrel portion 17 is formed such that a pair of crimped pieces 21 thereof are raised in one direction, from both sides of the base portion 19 in a width direction.

A curved surface 22 that is configured to extend along the outer circumferential surface of a second conductor 12 is formed on the inner side of each barrel portion 17. Also, the outer surface of each barrel portion 17 is curved so as to have an arc shape that is configured to extend along the inner circumferential surface of a tubular member 16. As shown in FIG. 4, the length of the barrel portion 17 in the axial direction is substantially equal to the length, in the axial direction, of a portion of the second conductor 12 exposed from the insulation coating 14.

Each tubular member 16 is made of metal (such as a stainless metal), and has an inner diameter that allows both an end portion of the first conductor 11 and an end portion of a second conductor 12 to be inserted thereinto. Each tubular member 16 has a closed circular cross section that is continuous along the entire circumference without a gap. The length of each tubular member 16 in the axial direction is large enough to electrically connect the first conductor 11 and a second conductor 12, and is substantially equal to the length of an overlapping portion 15 (an overlapping length).

As shown in FIG. 3 (D), each tubular member 16 is substantially uniformly crimped along the entire circumference, and is shrunken so as to have a circular shape. The outer diameter of each tubular member 16 is smaller than the outer diameter of the conductor body portion 18 of the first conductor 11. Inside each tubular member 16, a barrel portion 17 encloses half or more of one side of the outer circumferential surface of a second conductor 12 so that the metal strands 13 of the second conductor 12 are in contact with each other without a gap, and the outer circumferential surface of the second conductor 12 and the inner circumferential surface of the barrel portion 17 are in contact with each other without a gap. Inside each tubular member 16, a barrel portion 17 and a second conductor 12 are integrated into a single rod-shaped member that has a substantially circular cross section, and the inner circumferential surface of the tubular member 16 is in contact with the respective outer circumferential surfaces of the barrel portion 17 and the second conductor 12 without a gap.

Next, the following describes an example of the task of connecting the first conductor 11 and a second conductor 12 to each other according to the present embodiment.

First, a barrel portion 17 is formed at an end portion of the first conductor 11. The end portion of the first conductor 11 is mostly separated from the conductor body portion 18 through stamping or the like, and then the separated end portion of the first conductor 11 is squashed toward the base portion 19 so as to be plate-shaped, and is curved such that both sides of the base portion 19 are raised toward the conductor body portion 18 (see FIG. 3(B)). Thus, a barrel portion 17 is formed at the end portion of the first conductor 11.

Next, an end portion of the second conductor 12 is placed on the curved surface 22 of the barrel portion 17. The second conductor 12 is located on the inner side of the barrel portion 17, and thus the outer surface of the second conductor 12 and the curved surface 22 of the barrel portion 17 are in surface contact.

Next, a tubular member 16 is set. A tubular member 16, which has been threaded onto the first conductor 11 or the second conductors 12 from the end thereof that is opposite to the connection end, is placed on the outer side of the overlapping portion 15 where the first conductor 11 and the second conductor 12 overlap each other.

Next, the tubular member 16 is crimped. Pressure is inwardly applied to the tubular member 16 from all directions. The tubular member 16 shrinks while expanding in the axial direction. The tubular member 16 is shrunken so as to have a circular shape, and is thus crimped onto the overlapping portion 15 where the first conductor 11 and the second conductor 12 overlap each other.

Thus, the task of connecting the first conductor 11 and the second conductor 12 is complete.

Next, the following describes actions and effects of the embodiment with the above-described configuration.

In the connection structure according to the present embodiment, an end portion of the first conductor 11 and an end portion of a second conductor 12 are placed so as to overlap each other in a radial direction, and a tubular member 16 is crimped onto the overlapping portion 15 where the first conductor 11 and the second conductor 12 overlap each other, so as to enclose the overlapping portion 15. With this configuration, the joint is provided with enough strength to resist a force applied in a direction in which the end portion of the first conductor 11 and the end portion of the second conductor 12 are detached from each other, and therefore it is possible to improve the reliability of connection between the first conductor 11 and the second conductor 12. Also, the first conductor 11 and the second conductor 12 are placed so as to overlap each other in a radial direction, and therefore the contact area between the first conductor and the second conductor is larger than, for example, when an end surface of the first conductor and an end surface of the second conductor are abutted against each other and connected.

Also, the end portion of the first conductor 11 has a barreled shape that encloses the end portion of the second conductor 12. This configuration increases the contact area between the first conductor 11 and the second conductor 12, and can improve connection reliability. Also, although there is the risk of the barrel portion 17 opening due to heat around the vehicle body B if the first conductor 11 is made of aluminum or an aluminum alloy, which are likely to thermally deform, the barrel portion 17 according to the present embodiment is enclosed by the tubular member 16 and is crimped, and therefore the barrel portion 17 can be prevented from thermally deforming and opening, which is particularly advantageous.

Also, the tubular member 16 is shrunken so as to have a circular shape. Here, in a case where one conductor is bonded to a flat plate-shaped portion of the other conductor through ultrasonic welding in a conventional way, the flat plate-shaped portion expands more outward compared to the original conductor. Therefore, there is a problem in which an edge is likely to be formed and a joint between the conductors is likely to catch on another component such as an outer sheath member. However, with the configuration according to the present embodiment, it is unlikely that an edge is formed on the joint between the first conductor 11 and the second conductor 12. Therefore, it is possible to prevent the joint between the first conductor 11 and the second conductor 12 from catching on the outer sheath member C or the like.

Other Embodiments

The present disclosure is not limited to the embodiment described based on the descriptions above and the drawings, and, for example, the following embodiments are also included in the technical scope of the present invention.

(1) The embodiment above describes an example in which the first conductor 11 is a pipe member. However, the present invention is not limited in this way, and the first conductor may be a single-core wire that has a configuration in which one conductor is enclosed by an insulation coating, for example.

(2) The embodiment above describes an example in which each second conductor 12 is a twisted wire conductor. However, the present invention is not limited in this way, and each second conductor may be a braided wire formed by braiding metal strands.

(3) In the embodiment above, each end portion of the first conductor 11 is barreled. However, the present invention is not limited in this way, and an end portion of each second conductor 12 may be barreled. In this case, if the first conductor is a hollow member such as a pipe, end portions of the pipe may be squashed so as to be solid rod-shaped.

(4) In the embodiment above, each barrel portion 17 encloses one side of the surface of a second conductor 12. However, the present invention is not limited in this way. For example, each barrel portion may enclose the entire circumference of a second conductor.

(6) In the embodiment above, only a second conductor 12 is set in a barrel portion 17 and is press-fitted to the barrel portion 17, using a tubular member 16. However, the present invention is not limited in this way. An end portion of an insulation coating that encloses a second conductor may also be set in a barrel portion and press-fitted to the barrel portion.

(7) In the embodiment above, each tubular member 16 is only crimped onto an overlapping portion 15 where the first conductor 11 and a second conductor 12 overlap each other. However, the present invention is not limited in this way. Each tubular member may be crimped onto an end portion of an insulation coating of a second conductor as well.

(8) In the embodiment above, the wire harness W includes two conductive wires 10. However, the present invention is not limited in this way, and the wire harness may include only one conductive wire, or three or more conductive wires.

(9) In the embodiment above, the wire harness W includes two conductive wires 10. However, the wire harness may also include a typical electrical wire that is not formed by connecting different types of conductors in addition to these conductive wires 10.

(10) The embodiment above shows a specific example of a section of a conductive wire 10 where the first conductor 11 and the second conductors 12 are used. However, a section of a conductive wire where the first conductor 11 and the second conductors 12 are used is not limited in this way, and may be changed as appropriate.

(11) The embodiment above shows an example in which the first conductor is a relatively rigid conductor and the second conductors are relatively flexible conductors. However, the present invention is not limited in this way, and the way in which different types of conductors are combined may be freely changed. For example, both of the different types of conductors may be relatively rigid conductors, or relatively flexible conductors.

(12) The embodiment above describes a case in which the wire harness W is a low-voltage harness. However, the present invention is not limited in this way, and may be applied to a high-voltage harness.

LIST OF REFERENCE NUMERALS

W: Wire Harness
11: First Conductor

12: Second Conductor
15: Overlapping Portion
16: Tubular Member

The invention claimed is:

1. A conductor connecting structure, comprising:

a first conductor and a second conductor that are elongated and are connected to each other in a lengthwise direction, wherein one conductor out of the first conductor and the second conductor is a pipe member and includes a U-shaped barrel portion that encloses at least part of an end portion of the other conductor of the first conductor and the second conductor, an end portion of the first conductor and an end portion of the second conductor overlap each other in a direction that intersects the lengthwise direction, a tubular member encloses, and is crimped onto, an overlapping portion where the first conductor and the second conductor overlap each other, the tubular member is shrunken so as to have a circular shape, and an outer diameter of the tubular member is smaller than an outer diameter of the first conductor.

2. A wire harness comprising a conductor connecting structure according to claim 1.

* * * * *